United States Patent [19]

Buck et al.

[11] 4,095,366

[45] Jun. 20, 1978

[54] BLOCK PUZZLE TOY

[76] Inventors: John Kenneth Buck; Linda Lee Buck, both of Rte. 3, Box 75, Baraboo, Wis. 53913

[21] Appl. No.: 730,794

[22] Filed: Oct. 8, 1976

[51] Int. Cl.[2] ..... A63H 33/08; A63J 21/00

[52] U.S. Cl. ..... 46/1 R; 272/8 R

[58] Field of Search ..... 272/8 R, 8 N, 8 D, 27 R, 272/27 B, 27 N, 9, 25; 273/155; 46/1 R, 1 L, 24, 25, 26

[56] References Cited

U.S. PATENT DOCUMENTS

| | | | |
|---|---|---|---|
| 2,809,467 | 10/1957 | St. Pierre et al. | 272/8 R X |
| 3,005,282 | 10/1961 | Christiansen | 46/25 |
| 3,530,614 | 9/1970 | Strongin | 46/1 R |

FOREIGN PATENT DOCUMENTS

| | | | |
|---|---|---|---|
| 396,394 | 1/1909 | France | 46/1 R |

*Primary Examiner*—Richard C. Pinkham
*Assistant Examiner*—Arnold W. Kramer
*Attorney, Agent, or Firm*—Andrus, Sceales, Starke & Sawall

[57] ABSTRACT

The invention is directed to a block puzzle toy made of articulated or tumbling blocks formed from half blocks which are uniquely assembled and hinged together by bands with the connections to the blocks hidden inside the blocks and with which numerous coin tricks may be readily accomplished.

The connections consist of complementary pegs and serrated sockets disposed within the hollow cavities of the half blocks which snap fit the half blocks into whole blocks with the ends of each band having a hole therein to fit over a peg within the respective cavities and so be held with the end concealed from view when the half blocks are snap fitted together.

1 Claim, 7 Drawing Figures

BLOCK PUZZLE TOY

BACKGROUND OF THE INVENTION

The invention is particularly directed to a block puzzle toy which is particularly adapted for performing coin tricks. In the past block puzzle toys of this type have been made from wooden blocks with the bands joined to the blocks tacked to the outside of the blocks. The present invention employs two sets of half blocks which are uniquely assembled and the connections of the bands to the half blocks are hidden when the half blocks are assembled into blocks.

SUMMARY OF THE INVENTION

The invention in general comprises a plurality of plastic blocks with each block being made of half blocks of a high impact plastic such as polystyrene and with each half block having a shallow depth and side and end walls so that when the half members are forced or snapped together such as by an arbor press to form a block the internal construction of each block is hidden from view within the hollow space inside each block. Each half block is interchangeable as all have the same internal construction. Thus each half block internally has a pair of horizontally spaced pegs on one end and a pair of horizontally spaced sockets on the opposite end in alignment with the pegs. A socket is also located between the end pegs and a peg is located between the end sockets. Upon assembly of the half blocks to form blocks the pegs of a half block are received in complementary sockets in the complementary half blocks with which the pegs are assembled and aid in holding the half blocks together.

The pegs are employed to receive the ends of the bands which hinge the blocks together. Although numerous numbers of the blocks may be assembled together for performing coin tricks it has been found that six blocks or 12 half blocks provide the most satisfactory assembly and the invention will therefore be described hereinafter as employing six blocks or 12 half blocks and two sets of bands which hinge the blocks together, one of which will be described as white bands and the other as black bands.

The first set of half blocks with the white bands are assembled in three pairs whereas the second set of half blocks with the black bands are assembled in two pairs with a pair of the half blocks with the black bands connecting two pair of half blocks with the white bands. The end half blocks on one side of the puzzle have no bands and are merely employed to close the opposite end half blocks with which they are assembled.

The bands act as hinges for the blocks and the manner of securing the half blocks together to form blocks permits the blocks to be articulated in many different ways to perform many different puzzle tricks.

DESCRIPTION OF THE PREFERRED EMBODIMENTS

Figure 1:
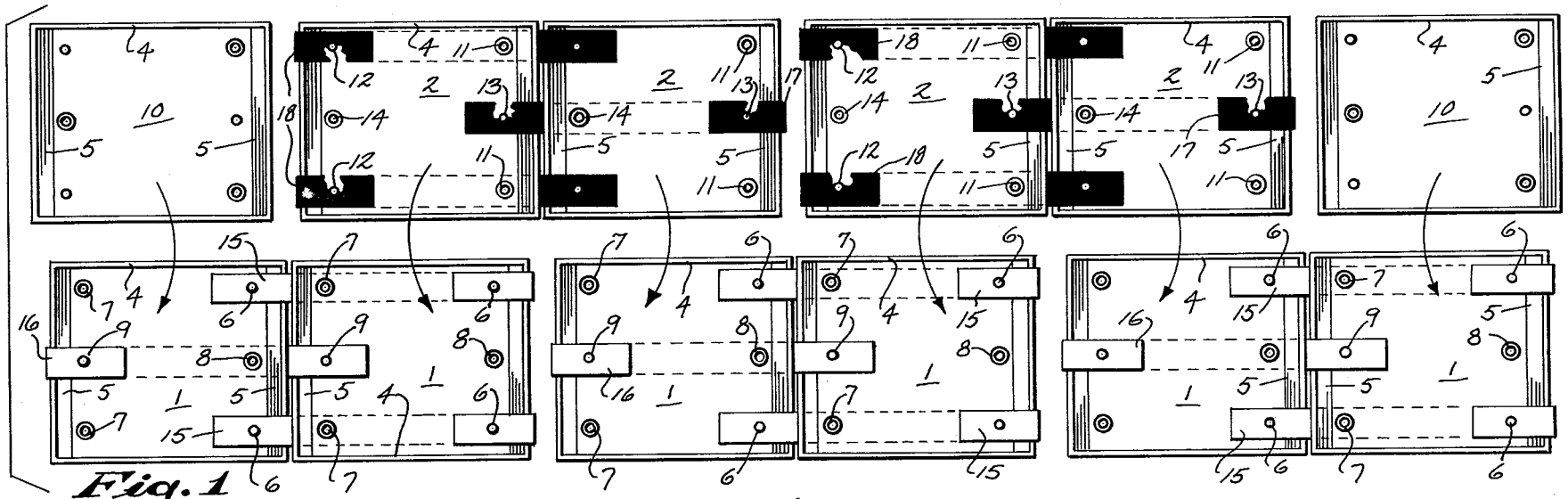
FIG. 1 is a top plan view of the half blocks in side-by-side position before assembly and the blocks have been spaced to some extent to illustrate the pairs of the first set of half blocks with the white bands which will be joined together by the second set of half blocks with bands which have been stippled to indicate that they are black, and with the end closure half blocks also spaced longitudinally from the adjacent half blocks.

Referring to the drawings in FIG. 1 there is shown for purposes of illustration a first set of six half blocks 1 located beside a second set of half blocks 2 making 12 half blocks which are ready to be assembled into six blocks 3.

Each half block may be of generally square shape and is bordered with a rim 4 which on the sides extends vertically but at the ends is provided with an inward taper. Therefore when the half blocks are assembled into block 3, each block 3 at the forward and rear end tapers inwardly toward the next block to form the tapered edges 5 which permits ready rocking of the end surface of each block 3 upon the adjacent block 3 when the block puzzle toy is manipulated. The half blocks are made of a high impact plastic such as polystyrene and are snapped together as with an arbor press to hold the same and to provide a smooth outer surface. A sharp instrument may be inserted at the joint area of a block 3 to open each block should that become desirable.

Referring to FIG. 1 the internal construction of half blocks 1 as there assembled are described hereinafter by reference to the left side of half blocks 1 as the rear end and the right side of the half blocks 1 as the forward end. Inside the forward end of half blocks 1 there is a pair of horizontally spaced pegs 6 and in alignment and opposite to pegs 6 at the rear end of each half block 1 are located the horizontally spaced sockets 7. Between pegs 6 at the forward end is centrally located a socket 8 and opposite socket 8 at the rear end of each half block 1 is located the peg 9 in alignment with forward socket 8 and centrally positioned between the rear sockets 7.

Now referring to the adjacent half blocks 2 these are located so that two half blocks 2 when the half blocks are assembled into blocks 3 will be assembled with a pair of half blocks 1. The end half blocks 10 seen in FIG. 1 are merely used to close the end half blocks 1.

The half blocks 2 are assembled so that the internal parts are opposite the half blocks 1. Thus in half block 2 starting in FIG. 1 at the left, inside the forward end of these half blocks is a pair of horizontally spaced sockets 11 and in alignment with and opposite to pegs 6 of half blocks 1. At the rear end of each half block 2 are located the horizontally spaced pegs 12 and these are in alignment with and opposite to sockets 7 of half blocks 1. Between sockets 11 at the forward end is centrally located a peg 13 and opposite peg 13 at the rear end of each half block 2 is located the socket 14 in alignment with forward peg 13 and centrally positioned between the rear pegs 12.

When the half blocks 1 and 2 are assembled into block 3, the pegs 12 and 13 of half blocks 2 are received in sockets 7 and 8 of half blocks 1 and the pegs 6 and 9 of half blocks 1 are received within the sockets 11 and 14 of half blocks 2.

The hinging together of the half blocks so that the assembled blocks 3 can be manipulated to perform various tricks is accomplished by a series of bands assembled with each set of half blocks.

For purposes of description the bands 15 assembled with the half blocks 1 are shown as white and the bands 18 assembled with the half blocks 2 are shown as black.

Starting at the left side in FIG. 1 and the other figures of the drawing with half blocks 1 there are three pair of half blocks 1. The two half blocks 1 in each pair are hinged together by a pair of white bands 15 which are secured at the ends to pegs 6 of the left half block 1 and extend in pairs over the outer side of half block 1 and then inwardly of half block 1 and are secured to the pegs 6 at the forward end of the next adjacent half block 1. In addition a single white band 16 is secured internally to the peg 9 at the rear end of the first block and extends outwardly over the outer surface of the next adjacent half block and then inwardly thereof to be secured to the rearwardly located peg 9 of the adjacent half block.

Next there is shown in the drawings two pair of half blocks 2. Thus in half blocks 2 starting with the first pair of half blocks 2 at the left in FIG. 1 inside the forward end of these blocks a single black band 17 is secured to the central peg 13 and then extends forwardly over the outer surface of the next adjacent half block 2 and then inwardly to be secured internally to the central peg 13 at the forward end of the next adjacent half block 2.

In addition a pair of horizontally spaced black bands 18 are secured internally to pegs 12 at the rear end of the first block and extend outwardly and forwardly over the half block 2 and then inwardly to be secured to the horizontally spaced pegs 12 at the rear end of the next adjacent block.

In the second pair of half blocks 2 the bands 17 and 18 are secured and extend the same as described with respect to the first pair of half blocks 2.

Figure 5:
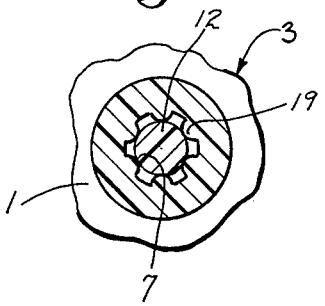
FIG. 5 is a sectional enlarged view illustrating a peg received within a socket.

When the half blocks 1 and 2 are assembled together as described to form blocks 3 the described bands 15, 16, 17 and 18 are securely held between the pegs and sockets and hinge the blocks together. The material of the bands is non-stretchable but the assembly of the bands with the blocks is accomplished in a fashion to provide a slight spacing between blocks 3 so that the blocks can be readily articulated to perform various coin tricks. The inside of the respective sockets is serrated at 19 on the inside as illustrated in FIG. 5 to securely hold the pegs.

Figure 3:
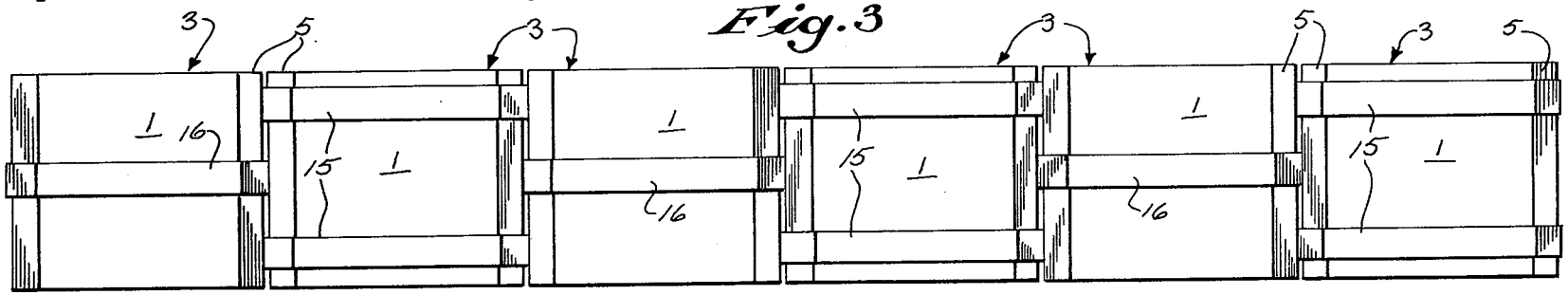
FIG. 3 is an assembled view of six blocks illustrating the extent of the white bands.
Figure 4:
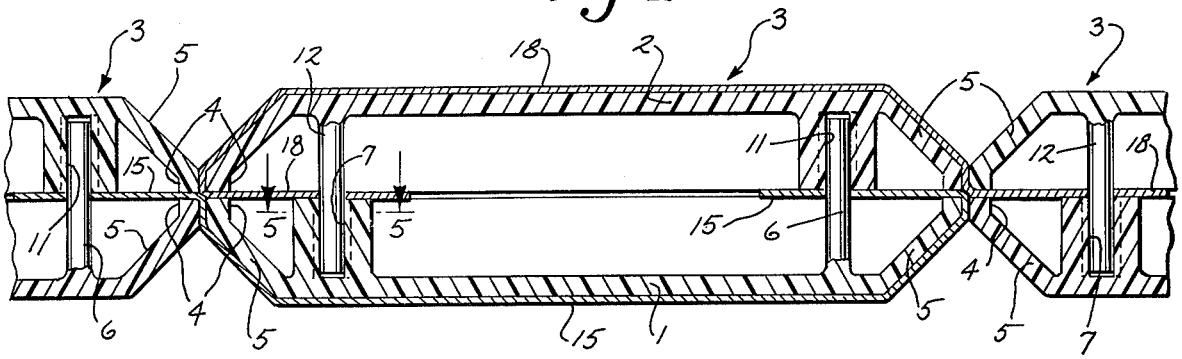
FIG. 4 is an enlarged sectional view taken on line 4—4 of FIG. 2.

Because of the particular banding connection starting at the right in FIG. 3 of the drawing showing blocks 3 assembled and with the white bands 15 and 16 in the upward position, the first block with the two bands 15 can be folded upon the single band 16 of the second block 3. The second block 3 with the single band 16 cannot be folded upon the third block 3 with the two bands 15 but can be folded underneath the third block 3. Again the third block 3 with two bands 15 can then be folded over the fourth block with the single band 16 and the fourth block can only be folded under the fifth block 3 and the fifth block 3 can only be folded over the sixth block.

Figure 2:
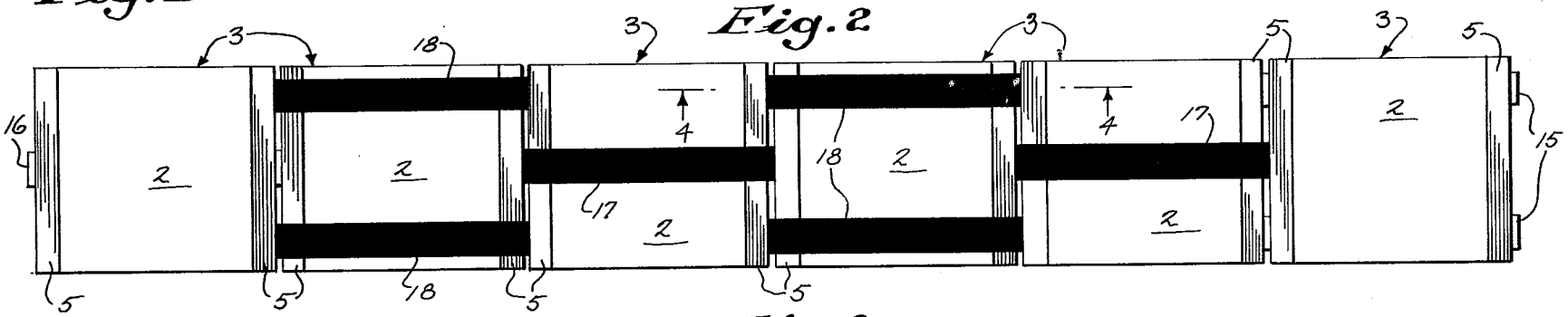
FIG. 2 is an assembled view of six blocks illustrating the extent of the black bands.

The half blocks 3 with the black bands in the up position fold just opposite to the half blocks 3 with the white bands. Starting at the right in FIG. 2 of the drawing, the end closure of block 3 folds beneath the second block, not over it. The second block 3 folds over the third block. The third block 3 folds under the fourth block 3. The fourth block 3 folds over the fifth block 3 and the fifth block 3 folds under the end block 3.

Figure 6:
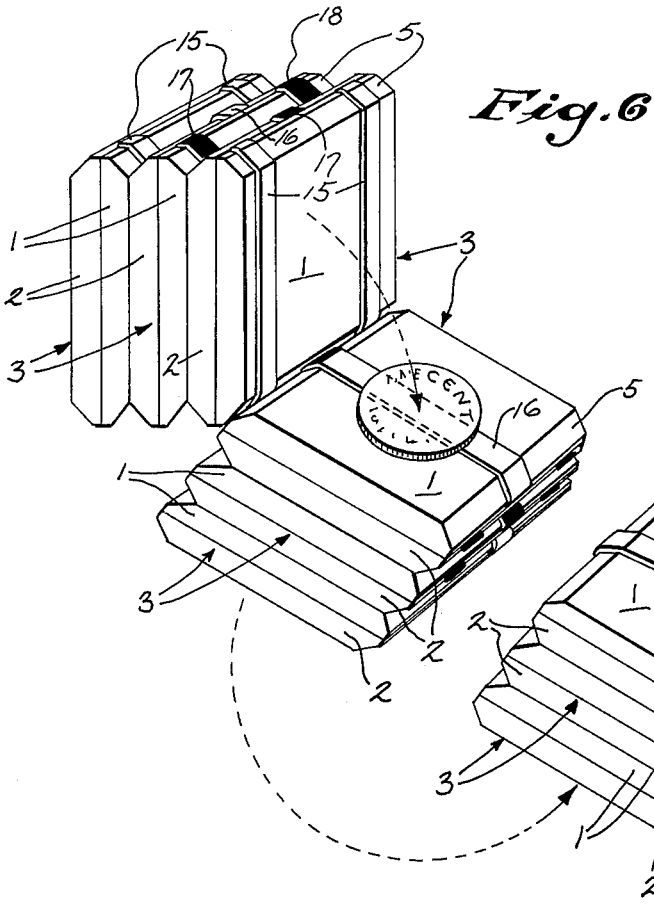
FIG. 6 is a perspective view illustrating the first step in a coin puzzle trick which can be accomplished.
Figure 7:
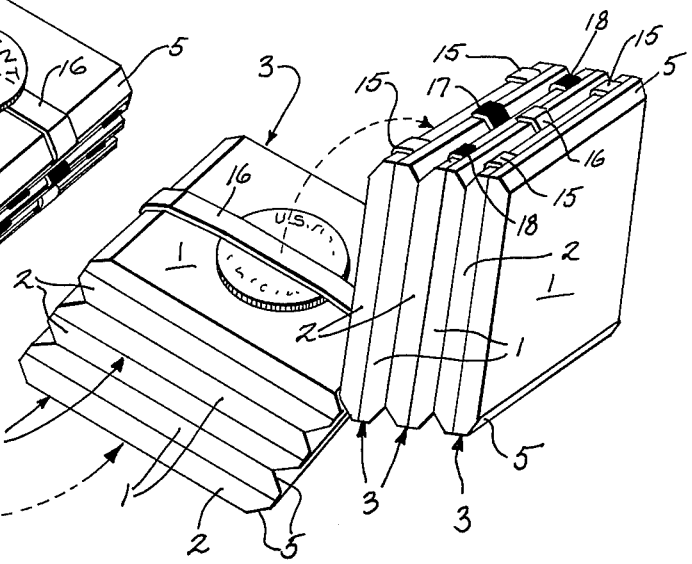
FIG. 7 is a perspective view illustrating the second step of the coin puzzle trick of FIG. 6.

The block puzzle toy can be employed to do many coin tricks and FIGS. 6 and 7 illustrate one of the tricks.

By way of example in FIG. 6 a coin has been placed on top of the white band 16. When the stack of blocks 3 is turned upside down and the blocks 3 opened on the side opposite to that illustrated in FIG. 6 the coin will then be located beneath a band 16. Numerous coin tricks have been devised and can be accomplished with the block puzzle toy.

The block puzzle toy of the invention is very versatile. The holding parts are concealed inside the blocks and the hinging bands are not only held by pegs but also by the closing of the half blocks to form blocks without sharp edges and a smooth outer surface.

Different colored bands or ribbons can be used and the black and white bands are shown only for purposes of illustration. All the half blocks are made the same and consequently are interchangeable.

Various modes of carrying out the invention are contemplated as being within the scope of the following claims particularly pointing out and distinctly claiming the subject matter which is regarded as the invention.

We claim:

1. A block puzzle toy which comprises a first set of a plurality of half blocks and a second set of a plurality of half blocks, the first set of half blocks consisting of at least three pairs of half blocks, the second set of half blocks consisting of at least two central pairs of half blocks and end half blocks, a snap fit securing the half blocks of the first set to the half blocks of the second set to provide each assembled block with a hollow cavity on the inside, hinge means joining the blocks together so that the blocks may be articulated to accomplish various puzzle tricks consisting of single bands of material extending generally centrally between and over and under the surface of the blocks with the ends of the bands disposed inside the hollow cavity of a respective block and a pair of horizontally spaced bands of material located outside the single bands and extending between the blocks and the ends of the latter bands disposed inside the hollow cavity of a respective block, and complementary pegs and serrated sockets disposed within the cavities of assembled half blocks and the ends of each respective band having a hole therein to fit over a peg in a respective cavity and be held between the peg and serrated socket when the peg is forced home in the socket as the half blocks are snap fitted together to thereby conceal within the cavities in the blocks the holding means for the bands.

* * * * *